United States Patent [19]

Parker

[11] Patent Number: 4,963,792

[45] **Date of Patent: * Oct. 16, 1990**

[54] SELF CONTAINED GAS DISCHARGE DEVICE

[76] Inventor: William P. Parker, Box 909, Waitsfield, Vt. 05673-0909

[ * ] Notice: The portion of the term of this patent subsequent to Jun. 28, 2005 has been disclaimed.

[21] Appl. No.: 212,220

[22] Filed: Jun. 27, 1988

Related U.S. Application Data

[63] Continuation-in-part of Ser. No. 21,472, Mar. 4, 1987, Pat. No. 4,754,199.

[51] Int. Cl.[5] ..... H05B 41/26; H01J 61/12

[52] U.S. Cl. ..... 315/58; 313/608; 313/637; 315/85; 315/248; 315/358

[58] Field of Search ..... 315/185 S, 248, 58, 315/344, 361, 358, 85; 313/608, 637

[56] References Cited

U.S. PATENT DOCUMENTS 2,268,870 1/1942 Greenlee .
3,873,880 3/1975 Riddell ..... 315/53
4,379,253 4/1983 Myer ..... 315/289

*Primary Examiner*—Eugene R. LaRoche
*Attorney, Agent, or Firm*—Lahive & Cockfield

[57] ABSTRACT

A gas discharge apparatus includes a discharge chamber including a transparent dome portion and an electrode-including base portion, which together enclose an ionizable gas. A cup-shaped base member is affixed at its periphery to the edge of the base portion of the discharge chamber. A power supply and discharge excitation network is disposed within the interior of the base portion. The power supply and discharge network include a pair of terminals. An oscillator and associated step-up output transformer powered from the terminals is positioned between the terminals and the discharge chamber. A field shield including a conductive sheet member is positioned between the terminals and the discharge chamber. The field shield is adapted to be electrically coupled to the electrode so that discharge-supporting electric fields may be established in the discharge chamber between the electrode and through the dome portion of that chamber to an effective ground electrode exterior to the chamber.

15 Claims, 3 Drawing Sheets

SELF CONTAINED GAS DISCHARGE DEVICE

CROSS-REFERENCE TO RELATED APPLICATION

This application is a continuation-in-part of applicant's co-pending application Ser. No. 021,472, filed Mar. 4, 1987, now U.S. Pat. No. 4,754,199 issued June 28, 1988.

BACKGROUND OF THE DISCLOSURE

The present invention is in the field of gas discharge devices and more particularly relates to gas plasma display devices.

Devices displaying electrically generated light phenomena are well known in the prior art. Early devices were developed along with the development of continuous sources of high potentials. Such high potentials permitted the generation of glow discharges in response to resultant electric currents in reduced pressure, air-filled vessels, with currents being on the order of microamperes up to tens of milliamperes at tens of thousands of volts. High voltage, high frequency effects were demonstrated by Nikoli Tesla in the early part of this century, based on the production of gas discharges in various gas filled vessels by induced currents generated by remote apparatus.

More recently, knowledge of the physics and chemistry of electrically generated gaseous discharges have led to the commercially significant development of devices like the neon sign and the flourescent lamp.

In addition, various plasma display devices have been developed based upon gas discharges. U.S. Pat. No. 2,004,577, U.S. Pat. No. 3,621,332, U.S. Pat. No. 3,629,654 and U.S. Pat. No. 4,035,690 illustrate such devices which are particularly useful in connection with alphanumeric displays often used in connection with digital computers and other instrumentation.

Further, plasma displays have also been developed into an art form. For example, transparent non-conductive spherical shells have been used to enclose regions containing ionizable gases, such as neon, and a hemispherical electrode. In such devices, external power supplies and associated circuitry coupled to the electrode establish a high frequency electric field within the spherical shell (or enclosure) between the enclosed electrode and an external ground electrode. Visible electric discharges form along the electric field within the shell. At the high frequencies of the excitations, the resultant electric fields may be maintained at sufficiently low amplitude to not penetrate human skin, or cause tissue damage, yet still establish a visible discharge within the shell. These dynamic and highly visual discharges can be observed to change in location and intensity by proximity with a conductive body such as a user's hand. The operation of such a device depends upon the conductive nature of an ionized gas within the shell to form the first element of a capacitor, the wall of a hollow glass enclosure as the dielectric for that capacitor and a conductive object, for example, a user's hand, as the second element. Changes in the location of the second element will affect the areas of highest capacitive coupling, perturbing the distribution of ionized gas in the shell, producing user controlled variable visible effects. The capacitive coupling to human tissue is due to the high concentration of water and various ions in the body. Such devices permit a user to directly and safely interact with the electric field and visual discharge inside the shell.

However, the geometry of such prior art devices generally permits the electric field within the shell to extend substantially omnidirectionally from the discharge electrode in the shell. Moreover, the power supply and excitation network were considerably spaced apart from the discharge region. As a consequence of these factors, the user could very well interact with the field at points closer to the discharge electrode than the effective ground electrode. Prior art displays have not existed where the power supply (and effective ground electrode) were positioned closer to the discharge electrode than an interactive conductive bodies could be positioned.

It is an object of the present invention to provide an improved gas display device.

Another object is to provide an improved gas display device with a self contained power supply and excitation network.

SUMMARY OF THE INVENTION

Briefly, the present invention is an improved gas discharge apparatus. The apparatus comprises a discharge chamber including dielectric wall member enclosing a discharge region containing an ionizable gas. The wall member having a dome portion and a base portion. An electrode is disposed adjacent to or within the discharge region and opposite the dome portion of the discharge chamber. The apparatus couples ac electrical energy between the electrode and a point of potential reference. A field shield substantially prevents the establishment of an ac electric field from the discharge region and extending through the base portion of the discharge chamber to the point of potential reference.

With this configuration, the discharge excitation establishes a plasma discharge in the gas within the discharge chamber. That discharge extends in the direction of an electric field established between the electrode and through at least a portion of the dome to an effective ground electrode exterior to the discharge chamber. The field shield generally has the form of a conductive sheet member electrically coupled to said electrode.

In a preferred form of the invention, the apparatus comprises a discharge chamber including a dielectric wall member enclosing a discharge region containing an ionizable gas. The discharge chamber has a base portion and a transparent dome portion extending from the periphery of said base portion. The base portion includes an electrode portion extending inwardly into said discharge region. A conductive layer is positioned on at least a portion of the electrode portion.

A cup-shape base member is coupled at its peripheral edge to periphery of the base portion of the discharge chamber, defining an enclosed interior region for base member. In one form of the invention, the composite outer of the discharge chamber and base member is substantially spherical, although other shapes may be used.

A power and discharge excitation network is disposed substantially within the interior region of the base member. The power supply includes a pair of electrical terminals adapted for coupling a dc potential difference across those terminals. The terminals are disposed within interior region of the base member. In various forms of the invention, the power supply may include just the terminals (and an adaptor for coupling the terminals to an external dc power source), or may include the terminals and batteries (rechargeable or non-rechargeable), with or without an integral battery charging circuit, and/or an ac-to-dc converter for coupling the terminals to an external ac power source.

An electrical oscillator network is electrically connected to the terminals and is powered thereby. The oscillator includes a relatively high turns-ratio output transformer having a high voltage secondary lead extending to and electrically coupled to the conductive layer on the electrode portion of the discharge chamber.

A field shield is disposed within the base member and between the terminals and the base portion of the discharge chamber. The field shield is adapted to substantially prevent the establishment of an electrical field within the base member and extending from the electrode portion of the discharge chamber and within the cup-shaped member between the base portion of the discharge chamber and the terminals. The field shield includes an electrically conductive sheet member which is coupled to the conductive layer on the region of the discharge chamber In one form of the invention, the sheet member extends about the voltage secondary lead and includes a plural of elongated portions extending outwardly from the lead and includes a circumferentially extend portion connected to the distal ends of the outwardly extending portions. In another form the sheet member extends about the high voltage secondary lead and is substantially annular. In various embodiments, the sheet member may be disposed between a pair of substantially planar dielectric members, or alternatively, may be affixed to a single substantially planar dielectric member.

With this configuration, the power supply and discharge excitation network establish a plasma discharge in the gas within the discharge chamber. The discharge extends in the direction of an electric field established by the power supply and excitation network between the electrode portion of the discharge chamber and through the dome portion of the discharge chamber to an effective ground electrode exterior to the discharge chamber.

A necessary element of the present invention is the field shield. This component electrically isolates the discharge chamber from the power supply and excitation network. Without the field shield, a high frequency gas discharge device otherwise similar to the invention normally exhibits discharge paths along the shortest path between electrode and ground due to the straight line nature of the electric field. The field shield of the present invention generally modifies the interactive effects on the discharge paths by capacitive coupling with a conductive body (for example, a user's hand, which generally will be at a greater straight line distance from the discharge electrode than is the discharge excitation network and its power supply.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1A:
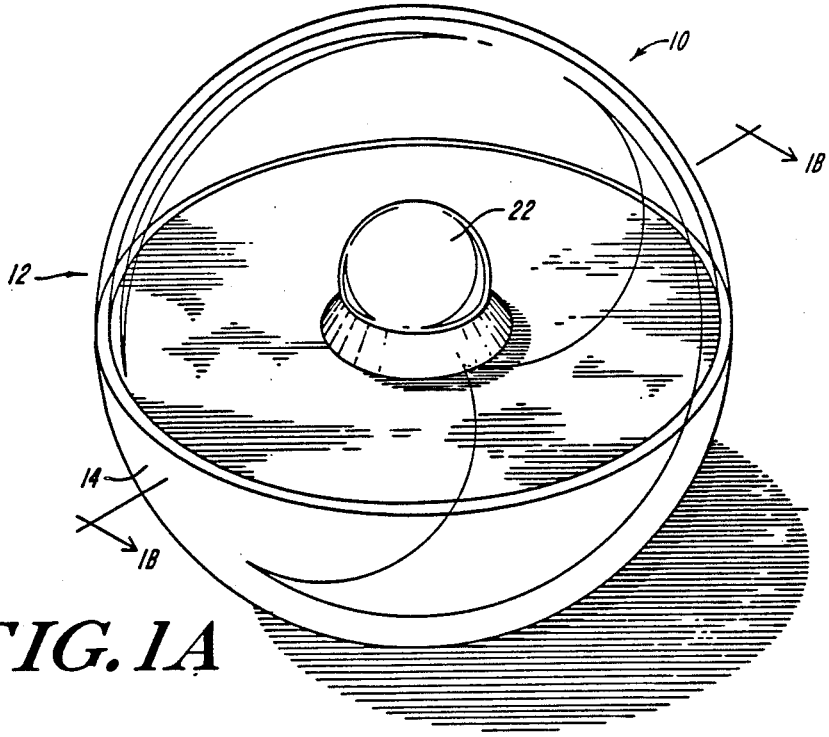
FIG. 1A shows in perspective view an exemplary gas discharge apparatus in accordance with the present invention.
Figure 1B:
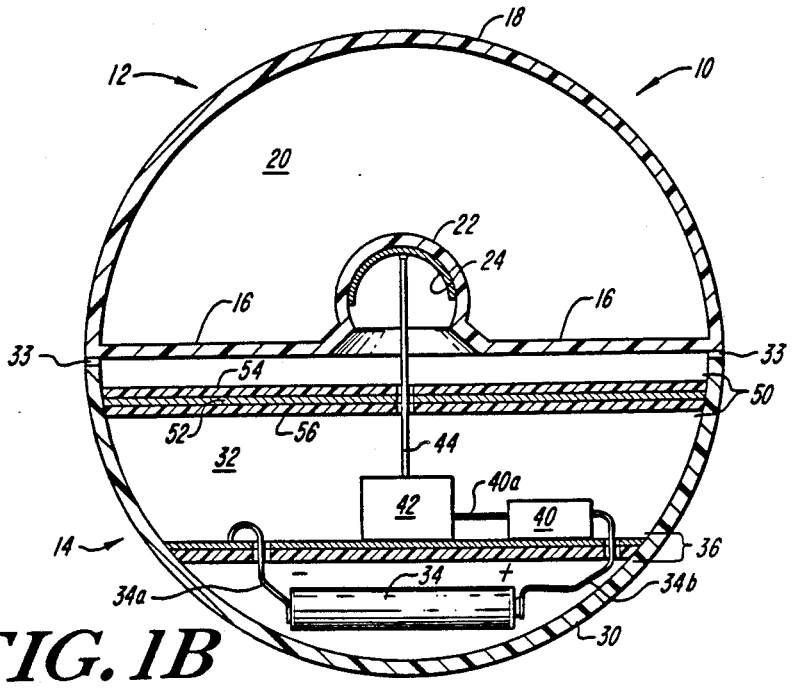
FIG. 1B shows a sectional view along lines 1B—1B of the gas discharge apparatus of FIG. 1A.

A gas discharge device 10 in accordance with the present invention is shown in perspective view in FIG. 1A, and partially in section and partially in schematic form in FIG. 1B. The device 10 generally includes two contiguous sections, the first of which is a hollow gas-filled discharge chamber 12 and the second of which is a power supply and excitation network section 14.

In the preferred form of the invention, the discharge chamber 12 is defined by a substantially uniform thickness, vitreous glass wall having a base portion 16 and a transparent dome portion 18. Base portion 16 and dome portion 18 enclose a discharge region 20. In other forms of the invention, dielectric materials other than glass may be used to form the chamber 12.

As illustrated, the outer surface of the dome portion 18 is hemispherical and the base portion 16 has a substantially circular periphery with a 4.5-inch outer diameter. The base portion 16 includes an inwardly extending electrode portion 22 having an electrically conductive layer 24 (such as an oven fired nickel oxide film) affixed to its exterior (to chamber 12) surface.

While in the preferred form of the invention, the discharge chamber 12 is a hemispherical hollow vitreous glass vessel, other shapes such as cylindrical, rectangular, cubic, or pyrimidal, regular or irregular in proportion and symmetry, and in any size, scale or volume. The chamber 12, or its component parts, may be fabricated with standard vacuum tube glass manufacturing methods, with wall thicknesses as required to withstand evacuation to a very small fraction of an atmosphere. Evacuation may be accomplished by means of an exhaust tubulation located in an area of the chamber surface not to be exposed to the view of an intended user of the device. In the alternate methods of manufacture, desired evacuation may be accomplished immediately prior to filing and sealing while the component parts of the chamber are inside a baking/filling-/sealing oven.

The electrode of the base portion 16 may be coated or covered with an adherent conductive paint, film, deposit, emulsion, tape, stencil, foil or other surface-contiguous element, which may have a simple or complex shape. Preferably, such coating or covering has a sheet resistance of 100,000 ohms per square or less. This conductive layer 24 may be on the interior or exterior surface of the chamber 12. In forms of the invention in which the conductive layer is interior to the chamber, a conventional glass-to-metal seal may be used in making electrical contact from the conductive layer through the glass wall of chamber 12 to a high voltage lead 44, described below. Alternately, a capacitive method of making electrical connection to the interior conductive layer may be used by placing a second conductive layer on the exterior surface of the vessel in direct opposition to the interior conductive layer. The second conductive layer may be of any shape or composition adapted to couple ac current to the interior conductive layer.

Figure 4:
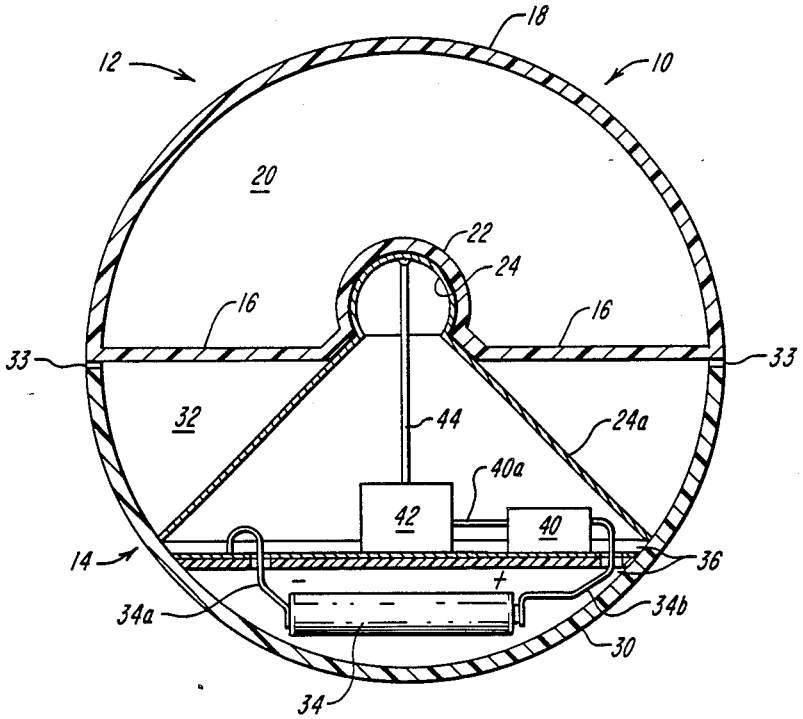
FIG. 4 shows an alternative embodiment of the invention.

In the preferred embodiment illustrated in FIGS. 1A and 1B, the layer 24 is exterior of the chamber and a high voltage is electrically connected to layer 24 a spring-biased wire. Alternatively, electrical may be made by foil, tape, circuit board conductive elastomer or other means having and mechanical contact with relatively low contact resistance and impedance. FIG. 4 shows an alternate embodiment in which the layer 24 is electrically joined to a conical conductive sheet 24*a*.

The interior 20 of the discharge chamber contains a gaseous atmosphere having single gas constituent or multiple gases in combination. Typical constituents of such an atmosphere are pure gases and mixtures of pure gases in any combination with CO, $CO_2$, the halogens, water vapor, mercury vapor, hydrocarbons, fluorinated hydrocarbons chlorinated hydrocarbons, alkali metal vapors, phosphorous vapors, alcohol vapors, halogenated hydrocarbons, hydrogen bromide, hydrogen chloride, hydrogen fluoride, sulfur hexafluoride, nitrogen tetrafluoride, phosphorous pentoxide freons, titanium tetrachloride, vapors of cadmium, zinc, and selenium; radioactive gases and the rare gases and their isotopes. The pressure of the gaseous atmosphere may range from high vacuum (less than .001 micron) to greater than atmospheric (760 torr). In alternate embodiments, the chamber 12 may be composed of several independent sub-chambers, each with its own gaseous atmosphere. In the preferred embodiment, the hemispherical chamber, 12 encloses a volume of approximately 500 ml. The atmosphere within chamber 12 is one selected from the gas mixture/pressure (Torr) examples, set forth in Table I below. Preferred pressures are shown in pa in Table I.

The power supply and discharge excitation network 14 includes a cup-shaped base member 30. In the preferred embodiment the base is a substantially uniform thickness, non-conductive hemispherical shell enclosing an interior region 32. The peripheral edge of the base 30 is cemented (or otherwise affixed) to the periphery of base 16 of discharge chamber 12 so that the interior region 32 is fully enclosed. By way of example, the base member may be made from epoxy resin. Other materials may alternatively be used, such as ABS plastic, polymethyl methacrylate, polystyrene or porcelain. The base member 30 is preferably opaque black to provide high visual contrast for plasma discharge in the chamber 12.

In various embodiments, portions of the inner surface of base 30 may have a conductive layer, such as nickel oxide, deposited thereon and acting as a local ground. In the preferred embodiment, as shown FIBS. 1A 1B, the outer surfaces of the dome portion 18 of discharge chamber 12 and base member 30 are held together by a joining element 33 (e.g. cement) to form a substantially spherical outer surface. In other embodiments, differently shaped outer surfaces, such as cubic, cylindrical, pyrimidal or other shapes, may similarly be established.

TABLE I

| | Mixture | | | | | | | | | | | | | | | | | |
|---|---|---|---|---|---|---|---|---|---|---|---|---|---|---|---|---|---|---|
| | I | | II | | III | | IV | | V | | VI | | VII | | VIII | | IX | |
| | Gas | % | Gas | % | Gas | % | Gas | % | Gas | % | Gas | % | Gas | % | Gas | % | Gas | % |
| | Xe | 2.59 | Kr | 3.0 | Ne | 96.0 | Xe | 99.99+ | Xe | 99.99+ | Ne | 85.0 | Ne | 98.0 | Xe | 99.99+ | Xe | 99.99+ |
| | He | 1.0 | He | 1.0 | $N_2$ | 3.0 | Cl | .0001 to .01 | F | .0001 to .01 | He | 10.0 | $N_2$ | 2.0 | Br | .001 to .01 | I | .001 to .01 |
| | Ne | 97.3 | Ne | 96.0 | $O_2$ | 1.0 | | | | | Xe | 5.0 | | | | | | |
| | Br | .0001 to .01 | | | | | | | | | | | | | | | | |
| Pressure (Torr) | 360 ± 20% | | 300 ± 20% | | 520 ± 15% | | 50–760 (100) | | 60–760 (120) | | 480 ± 20% | | 120–840 (810) | | 40–120 | | 40–120 | |

The discharge excitation network and an associated power supply are disposed within the region 32. The power supply includes a set of rechargeable batteries 34. The batteries may be nickel-cadmium, lead-acid, silver-cadmium or other conventional batteries. As shown, the batteries 34 are positioned in the lowermost portion of region 32. When NiCad batteries are used, an integral recharging circuit may be utilized as well. A recharging adapter (for coupling batteries 34 to an external power supply), not shown, may be positioned within or outside the base member 32. In one form of the invention, solar cells may be used for recharging, where such cells are supported beneath the transparent base portion 16 of chamber 12, for example. The solar cells are switched out of use during operation of the display.

A substantially planar conductive sheet member 36 is positioned above the batteries 34 in the region 32. In the preferred embodiment, the sheet member 36 is established by a copper clad, one-tenth inch thick, disk-shaped glass-epoxy composite board. The negative terminal 34*a* of battery 34 is electrically connected to the sheet member 36.

A waveform generating network is positioned on and below sheet member 36 within region 32 in the preferred form of the invention. The waveform generating network includes an oscillator 40 having an associated substantially high turns ratio (i.e. step up) output transformer 42, having a high voltage secondary lead 44. The oscillator 40 is electrically connected to the sheet member 36 and the positive terminal 34*b* of the batteries 34. In various embodiments, the waveform generating network may Provide a time varying signal, for example, sine wave or square wave, periodic or otherwise, and may also include various modulation, filtering or other signal modifying networks.

The embodiment of FIGS. 1A and 1B includes an integrated circuit astable multivibrator having operator adjustable frequency and duty cycle controls, and an FET amplifier, followed by a resonant core high-voltage transformer 42.

Figure 2:
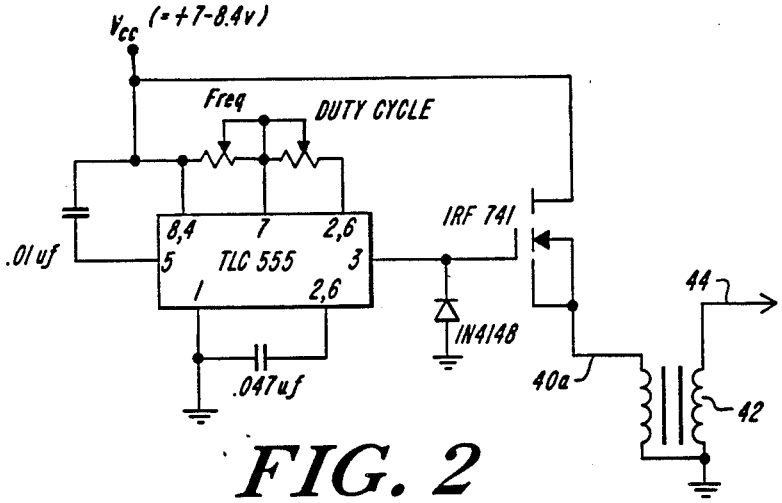
FIG. 2 shows, in schematic form, the excitation network of the gas discharge apparatus of FIGS. 1A and 1B.

An exemplary circuit is shown in FIG. 2 which uses a COSMOS type TLC 555 integrated circuit followed by an FET output amplifier. Generally, this circuit configuration is adjustable in the frequency range 5,000 to 80,000 Hertz, and has a maximum peak-to-peak output voltage of 2400 volts at lead 44 with a power consumption of approximately 3 watts derived from an 8.4 volt battery 34 made up of series connected nickel cadmium cells.

A field shield 50 is positioned in region 32 between the discharge excitation network and the base portion 16 of the discharge chamber 12. The field shield 50 electrically isolates the discharge chamber 12 from the interior region 32 of the base member 30. The output lead 44 from the transformer 42 extends through the field shield 50 and is connected (by a spring connection) to the conductive layer 24 on the output surface of electrode portion 22. The field shield 50 includes an electrically conductive sheet member 52. Preferably, the sheet member 52 is positioned on a dielectric substrate or sandwiched between two such substrates (as shown in FIG. 1B for substrates 54 and 56). The substrates may, for example, be constructed of one-eighth inch thick glass-epoxy composite boards, while the sheet member 52 may be copper cladding between the boards. Alternatively, for example, the field shield 50 may incorporate a one-quarter inch thick acrylic disk substrate with a 10,000 ohms per square nickel oxide coating on its top surface providing the sheet member 52.

The sheet member 52 is electrically coupled to the high voltage lead 44. In the preferred form of the invention, this electrical coupling is established by a 470 picofarad, 6 Kv capacitor (not shown in FIG. 1B) connected between lead 44 and sheet 52. Alternatively, the sheet member 52 may be directly connected to lead 44. The sheet member 52 is adapted to deflect ac electric fields within the discharge chamber 12 so that those fields pass from electrode region 24 of chamber 12, through region 20 and substantially through dome portion 18 to an effective ground electrode.

Figure 3A:
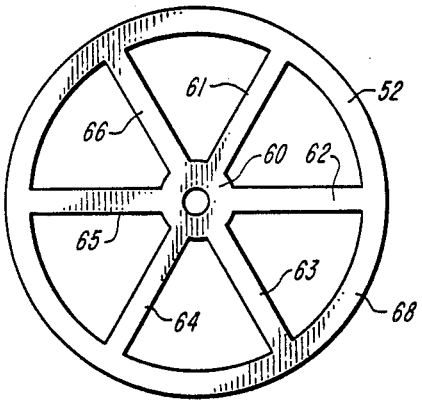
FIGS. 3A-3D show a plan views of exemplary conductive sheets for the field shield of the gas discharge apparatus of FIGS. 1A and 1B.
Figure 3B:
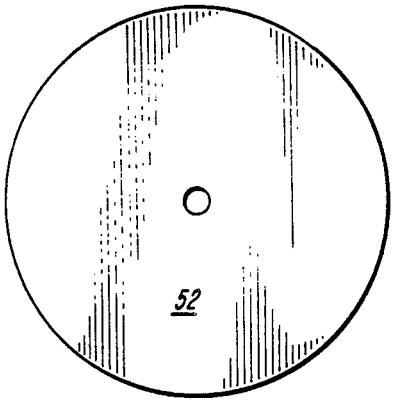
Figure 3C:
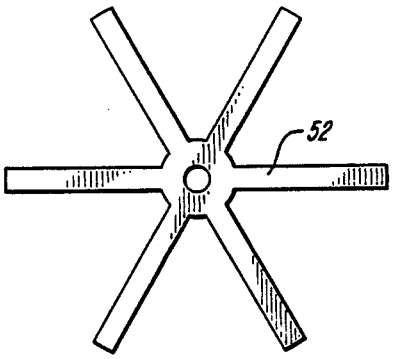
Figure 3D:
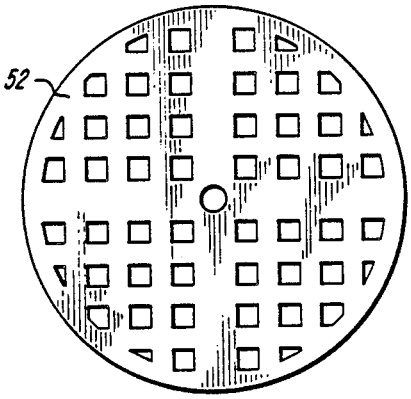

In the preferred embodiment, the sheet member 52 has a "wagon wheel" configuration (as shown in FIG. 3A) with a central annular region 60, six elongated, radially extending portions 61–66 and a circumferentially extending portion 68. In the present embodiment, the radial portions have a width equal to 0.04 inches and the circumferentially extending portion 68 have a width equal to 0.04 inches. Alternatively, the sheet member 52 may have the form of an annulus (as shown in FIG. 3B), a spiked Pattern (as shown in FIG. 3C, or a grid pattern (as shown in FIG. 3D). Still other configurations such as a helical geometry sheet, may be used.

The field shield 50 is effective for high frequency fields to provide a field deflecting conductive surface (or configuration of separate conductive elements which will generate a surface configuration that will deflect the field). In the preferred embodiment, this field shield 50 is interposed between the discharge chamber 12 and the power supply and discharge excitation network, and produces a very much longer path length for the electric field lines from the electrode 24 to the power supply ground potential. In practice, this shield has a minimum capacitance with the power supply ground, in order to minimize the power loss. Generally, the field shield 50 performs two functions: first the field shield blocks direct line electric field penetration between the discharge chamber and the power supply/-discharge excitation network. Second, the total capacitance of the field shield 50 with respect to the power supply ground is relatively low while still acting effectively under the first requirement. In view of the time varying nature of the high frequency electric field established at the electrode 24, the shield is configured so that its inductance is sufficiently low that the discharge may be maintained and power loss in the shield is relatively low. The high voltages involved both on the electrode region 20 and the field shield 50 require that insulation provided by substrates 54 (and 56) be constructed of a material such as phenolic plastic, epoxy resin, PTFE, or polystyrene characterized by low loss at the frequencies involved. These materials also are characterized by high resistance to corona effects, as well as high puncture voltage.

In practice, it has been found that the "wagon wheel" configuration including a radial pattern of conductive lines sandwiched between insulating layers of a glass fiber and epoxy composite (a printed circuit trace pattern between two layers of circuit board) placed between the discharge chamber and the power supply and discharge excitation network is a suitable configuration for field shield 50. In an alternate embodiment of the invention, the field shield 50 may be affixed directly to the discharge chamber 12.

In operation, the power the supply and discharge excitation network 14 provides a time varying electric field of sufficient intensity to generate a plasma discharge in the discharge chamber 12. The waveform of the electric field may be simple or complex; an example of a simple waveform is a sinewave; a complex waveform would have additional harmonic content and Fourier components. The waveform may be of a periodic nature or be non-repeating. The frequency and waveform of the signal applied to the conductive layer 24 electrode portion 22 is determined by several considerations including but not limited to: the intended brightness of the display, the range of intended gaseous discharge images, the power consumptiom allowance, the interaction with the electrical environment, external modulations of the signal by the user or other device and economy of production of the device. In determining the signal, several characteristics of the display section are selected, including, but not limited to, the gas composition, the gas pressure, the gas volume, the discharge chamber geometry, the shape of the electrode(s), the area of the electrode(s), the location of electrode(s), the sheet resistance of the electrode(s), the electrode inductance and impedance, the glass capacitance and capacitive reactance, and the loss factors for the glass and the electrodes. These parameters may be readily determined using conventional techniques, provided that appropriate consideration is made for the field shield 50.

While the preferred embodiments have been described as including a battery, rechargeable or otherwise, within the base member 30, other forms of the invention may include an ac-to-dc converter within the base member and a suitable coupling to an ac power source. In still other forms of the invention, a dc potential may be externally provided (for example, transferred by a pair of conductors external to the device 10) to the terminals within the base member. In all embodiments, the field shield substantially causes the ac field to pass from the discharge chamber through the dome portion of the chamber and to an effective ground potential.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A gas discharge apparatus, comprising:

A. a discharge chamber including a dielectric wall member enclosing a discharge region containing an ionizable gas, said wall member having a dome portion, and a base portion, B. an electrode disposed adjacent to or within said discharge region and opposite said dome portion of said discharge chamber, C. means for coupling ac electrical energy between said electrode and a point of potential reference external to the discharge chamber, D. field shield including preventing means for substantially preventing the establishment of an ac electric field from said discharge region and extending through said base portion of said discharge chamber to said point of potential reference, wherein said ionizable gas in said discharge chamber includes a gas mixture at a pressure in the approximate range 100–810 torr.

2. A gas discharge apparatus according to claim 1 wherein said gas mixture consists essentially of a mixture selected from the group consisting of:

A. Xenon, Helium, Neon and Bromine with approximate proportions equal to 2.59, 1.0, 97.3, and 0.01 per cent (%), respectively, B. Krypton, Helium, and Neon with approximate proportions equal to 3.0, 1.0, and 96.0 per cent (%), respectively, C. Neon, Nitrogen, and Oxygen with approximate proportions equal to 96.0, 3.0, and 1.0 per cent (%), respectively, D. Xenon and Chlorine with approximate proportions equal to 99.99 and .01 per cent (%), respectively, E. Xenon and Fluorine with approximate proportions equal to 99.99 and .01 per cent (%), respectively, F. Neon, Helium, and Xenon with approximate proportions equal to 85.0, 10.0, and 5.0 per cent (%), respectively, and G. Neon and Nitrogen with approximate proportions equal to 98.0 and 2.0 per cent (%), respectively.

3. A gas discharge apparatus according to claim 2 wherein said mixture is at an approximate pressure respectively equal to:

A. 360 torr
B. 300 torr
C. 520 torr
D. 100 torr
E. 120 torr
F. 480 torr, and
G. 810 torr.

4. An ionizable gas composition of matter for disposition in the enclosed discharge chamber of a gas plasma display device, comprising:

a gas mixture consisting essentially of a mixture selected from the group consisting of:

A. Xenon, Helium, Neon and Bromine with approximate proportions equal to 2.59, 1.0, 97.3, and 0.01 per cent (%), respectively, B. Krypton, Helium, and Neon with approximate proportions equal to 3.0, 1.0, and 96.0 per cent (%), respectively, C. Neon, Nitrogen, and Oxygen with approximate proportions equal to 96.0, 3.0, and 1.0 per cent (%), respectively, D. Xenon and Chlorine with approximate proportions equal to 99.99 and .01 per cent (%), respectively, E. Xenon and Fluorine with approximate proportions equal to 99.99 and .01 per cent (%), respectively, F. Neon, Helium, and Xenon with approximate proportions equal to 85.0, 10.0, and 5.0 per cent (%), respectively, and G. Neon and Nitrogen with approximate proportions equal to 98.0 and 2.0 per cent (%) respectively.

5. An ionizable gas composition of matter according to claim 4 wherein said mixture is at an approximate pressure in said discharge chamber respectively equal to:

A. 360 torr
B. 300 torr
C. 520 torr
D. 100 torr
E. 120 torr
F. 480 torr, and
G. 810 torr.

6. A gas discharge apparatus according to claim 1 wherein said gas mixture consists essentially of a mixture selected from the group consisting of:

A. Xenon, Helium, Neon, and Bromine with approximate proportions 2.59, 1.0, 97.3+, and in the range 0.0001 to 0.01 per cent (%), respectively, B. Krypton, Helium, and Neon with approximate proportions 3.0, 1.0, and 96.0 per cent (%), respectively, C. Neon, Nitrogen, and Oxygen with approximate proportions 96.0, 3.0, and 1.0 per cent (%), respectively, D. Xenon and Chlorine with approximate proportions in the range 99.99+ and in the range .01 to .0001 per cent (%), respectively, E. Xenon and Fluorine with approximate proportions 99.99+ and in the range .01 to .0001 per cent (%), respectively, F. Neon, Helium, and Xenon with approximate proportions 85.0, 10.0, and 5.0 per cent (%), respectively, G. Neon and Nitrogen with approximate proportions 98.0 and 2.0 per cent (%), respectively, H. Xenon and Bromine with approximate proportions equal to 99.99± and in the range 0.0001 to 0.01 per cent (%), respectively, and I. Xenon and Iodine with approximate proportions equal to 99.99± and in the range 0.0001 to 0.01 per cent (%), respectively.

7. A gas discharge apparatus according to claim 6 wherein said mixture is at a pressure in the respective ranges:

A. 360 torr ±20 per cent (%)
B. 300 torr +20 per cent (%)
C. 520 torr ±15 per cent (%)
D. 50 to 760 torr
E. 60 to 760 torr
F. 480 torr ±20 per cent (%)
G. 120–840 torr
H. 40–120 torr, and
I. 40–120 torr.

8. An ionizable gas composition of matter for disposition in the enclosed discharge chamber of a gas plasma display device, comprising:

a gas mixture consisting essentially of a mixture selected from the group consisting of:

A. Xenon, Helium, Neon, and Bromine with approximate proportions 2.59, 1.0, 97.3+, and in the range 0.0001 to 0.01 per cent (%), respectively, B. Krypton, Helium, and Neon with approximate proportions 3.0, 1.0, and 96.0 per cent (%), respectively.

C. Neon, Nitrogen, and Oxygen with approximate proportions 96.0, 3.0, and 1.0 per cent (%), respectively, D. Xenon and Chlorine with approximate proportions 99.99+ and in the range .01 to .0001 per cent (%), respectively, E. Xenon and Fluorine with approximate proportions 99.99+ and in the range .01 to .0001 per cent (%), respectively, F. Neon, Helium, and Xenon with approximate proportions 85.0, 10.0, and 5.0 per cent (%), respectively, G. Neon and Nitrogen with approximate proportions 98.0 and 2.0 per cent (%), respectively, H. Xenon and Bromine with approximate proportions equal to 99.99± and in the range 0.001 to 0.01 per cent (%), respectively, and I. Xenon and Iodine with approximate proportions equal to 99.99+ and in the range 0.001 to 0.01 per cent (%), respectively.

9. An ionizable gas composition of matter according to claim 8 wherein said mixture is at a pressure in said discharge chamber in the respective ranges:

A. 360 torr ±20 per cent (%)

B. 300 torr ±20 per cent (%)

C. 520 torr ±15 per cent (%)

D. 50 to 760 torr

E. 60 to 760 torr

F. 480 torr ±20 per cent (%)

G. 120–840 torr

H. 40–120 torr, and

I. 40–120 torr.

10. A gas discharge apparatus, comprising:

A. a discharge chamber including a dielectric wall member enclosing a discharge region containing an ionizable gas, said wall member having a dome portion, and a base portion, B. an electrode disposed adjacent to or within said discharge region and opposite said dome portion of said discharge chamber, C. means for coupling ac electrical energy between said electrode and a point of potential reference external to the discharge chamber, D. field shield including preventing means for substantially preventing the establishment of an ac electric field extending from said discharge region and through said base portion of said discharge chamber to said point of potential reference, said preventing means including a conductive sheet member, said sheet member being electrically coupled to said electrode and extending from said electrode and underlying at least in part said base portion.

11. A gas discharge device according to claim 10 further comprising circuit means for generating said ac electrical field, said circuit means being separated from said base portion by said field shield.

12. A gas discharge device according to claim 11 wherein said circuit means includes a dc power source.

13. A gas discharge device according to claim 12 wherein said dc power source includes a rechargeable battery.

14. A gas discharge device according to claim 13 wherein said circuit means further includes a recharging circuit coupled to said rechargeable battery.

15. A gas discharge device according to claim 14 wherein said circuit means further includes one or more solar cells and circuit means for coupling said solar cells to said recharging circuit.

* * * * *